US006045453A

United States Patent [19]

Jenkins

[11] Patent Number: 6,045,453

[45] Date of Patent: Apr. 4, 2000

[54] GOLF CLUBHEAD FOR PUTTING OR CHIPPING THE GOLFBALL

[76] Inventor: Robert E. Jenkins, 2903 Hillview Rd., Austin, Tex. 78703

[21] Appl. No.: 09/146,190

[22] Filed: Sep. 1, 1998

[51] Int. Cl.[7] ..... A63B 53/04; A63B 69/36

[52] U.S. Cl. ..... 473/255; 473/340; 473/349; 473/328

[58] Field of Search ..... 473/255, 324, 473/340, 341, 349, 326, 327, 328

[56] References Cited

U.S. PATENT DOCUMENTS

| | | |
|---|---|---|
| D. 192,473 | 3/1962 | Ray . |
| 3,515,389 | 6/1970 | Wolfe . |
| 3,758,115 | 9/1973 | Hoglund . |
| 3,888,484 | 6/1975 | Zitko . |
| 4,138,117 | 2/1979 | Dalton . |
| 4,173,343 | 11/1979 | Richilano . |
| 4,964,639 | 10/1990 | Tucker . |
| 5,046,740 | 9/1991 | D'Eath . |
| 5,072,941 | 12/1991 | Klein . |
| 5,080,365 | 1/1992 | Winchell . |
| 5,121,922 | 6/1992 | Harsh . |
| 5,470,070 | 11/1995 | Bendo . |
| 5,494,282 | 2/1996 | Pranio . |
| 5,795,239 | 8/1998 | Lin . |

*Primary Examiner*—Sebastiano Passaniti

[57] ABSTRACT

The new golf putter/chipper clubhead of this invention, which is generally hammer shaped both in plan view and in cross section, provides for an easily accomplished true pendulum swing by concentrating the mass of the club at the very perimeter of the arc of the pendulum, on-line with the direction of swing. The concentration of clubhead mass, being very low and directly behind the ball striking area of the clubhead makes it much easier to get very solid ball contact. A single club using this clubhead design can be used either right or left handed, even though there is but one ball striking face. The unique design enables contrasts in color, and/or texture, and/or reflective angle to be used to graphically alien the clubhead before and during the stroke. By optimizing the clubhead weight, as described in this invention, regulating the length of chips and/or putts essentially becomes an exercise in simply regulating the length of the backswing. A clubhead of this invention's design is effective for conventional shaft length putters or chippers as well as for long shafted putters or chippers because the principles required for making good shots are the same for either, and the many advantages of the clubhead of this invention likewise hold true for both shaft lengths.

10 Claims, 2 Drawing Sheets

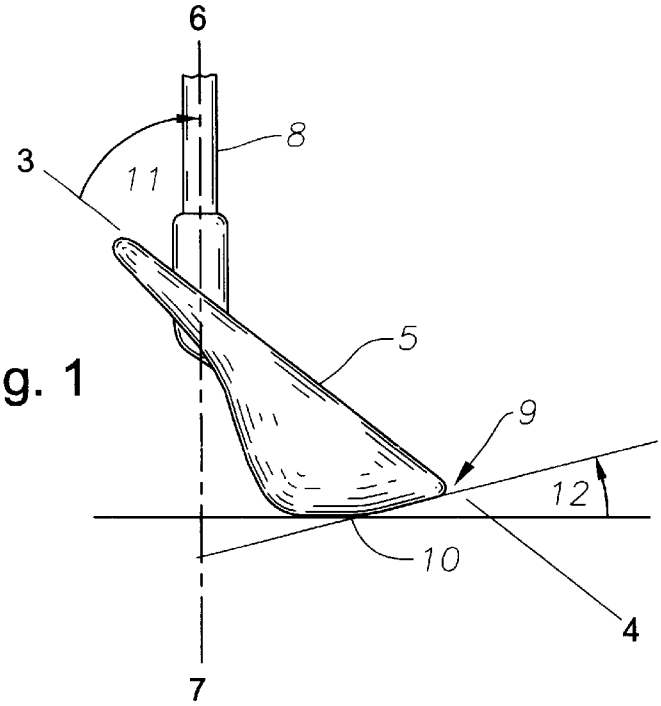
Fig. 1
Fig. 2
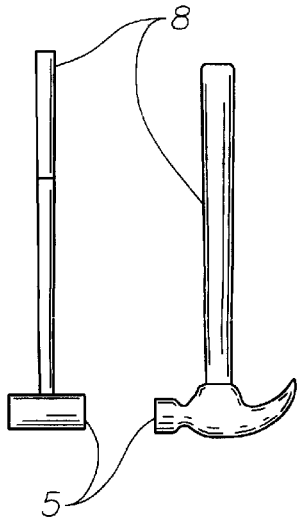
Fig. 3
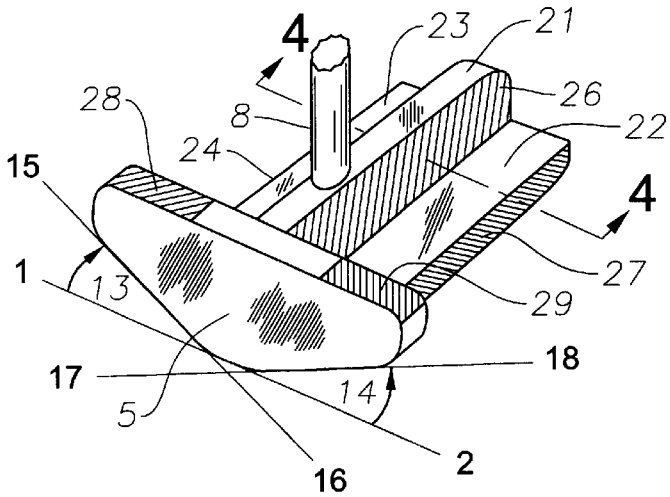
Fig. 4
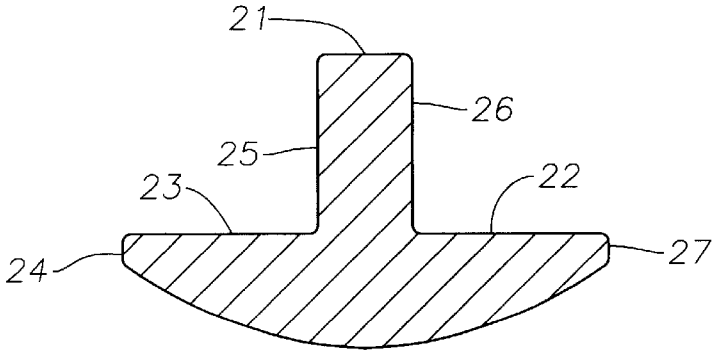

GOLF CLUBHEAD FOR PUTTING OR CHIPPING THE GOLFBALL

BACKGROUND OF THE INVENTION

1. Field of the Invention

This invention relates to certain clubhead design characteristics which can be incorporated for use in those golfclubs which are used for the relatively short strokes which are required in the game of golf . . . specifically, an improved golf clubhead for putting the golfball, and one of similar basic design for chipping the golfball.

Generally, the only difference between a clubhead designed to putt the golfball and one designed to chip the golfball is simply the difference in loft angle of the club's striking face. Loft angle being that angle between the striking face of the clubhead and its shaft, measured in that vertical plane which is parallel to the expected flight of the ball. (See FIG. 1—Angle 11) A putter's loft is limited by the U.S.G.A. Rules of Golf to 10 degrees or less.

Except for loft, most of the same principles apply to both clubs, or clubheads, since both putting and chipping require a similar pendulum type of stroke, and most putters and chippers both have an actual clubhead weight between 150 and 380 grams.

2. Description of Related Art

There are literally hundreds of putter head styles, all created with the hope getting the golfball into the hole in the fewest number of putting strokes, but very few if any, have any real scientific reason for its shape and design. There are considerably fewer styles of club made exclusively for chipping the golfball, because most good golfers can gently use one of their lofted "fill swing" clubs, such as a pitching or sand wedge or a 7, 8 or 9 iron.

The art related to golf club design has generally been an effort to develop golf clubs (including putters and chippers), that help the accomplished golfer improve his game. This invention is very different, being specifically directed toward assisting the less proficient or older golfer, although these same principles will likely have a strong following with many low handicap players.

Items of interests related to this invention are the disclosures found in U.S. Pat. Nos. 4,199,144; 4,312,509; 4,189,144; 4,754,978; & 4,986,541; 5,465,970; plus D 346,191; & D 360,668.

SUMMARY OF THE INVENTION

The highly accomplished, low handicap golfer has the muscle discipline and control to consistently strike the desired part of the golfball with the desired part of the clubface traveling along the desired stroke pathway, while maintaining the desired attitude, altitude, and alignment of the clubface. That golfer can attain excellent golfing results using most existing conventional clubs.

Not so for many of us who badly need to limit the ill effects of the not-so-perfect stroke!!

The golf putter/chipper head of this invention is shaped, colored, textured, and weighted so as to maximize the less-than-expert golfer's ability to align the clubhead both before and during the golfstroke, to encourage that golfer to produce a smooth, steady, stroke through the ball, and even to minimize the undesirable results of a somewhat irregular stroke. This is accomplished by shaping the clubhead so it does not easily catch on the ground, so that it is easily aliened both with the target, and with the golfers eyes, and by weighting the clubhead such that the length of the shot can be more easily related to the length of the backswing.

BRIEF DESCRIPTION OF THE DRAWINGS

FIG. 1 is a side view of a representative standard golf club (viewed from the end of its blade) showing the club sitting in a soled position on the ground (dotted line 1–2); showing dotted line (3–4) passing across and being in contact with the striking face (5) of the club; showing dotted line (6–7) passing through the center of the shaft (8); and showing dotted line (9–10) passing through the lowest point on the striking face and through the front most point on the sole of the club that touches the ground (10). The angle (11) between line (1–2) and line (3–4) is the "loft angle", and the angle (12) between line (1–2) and line (9–10) is the "bounce angle" (12) or simply the "bounce" of the club.

FIG. 2 is a side view of a golf club or mallet, from a point at right angles from the projected path of the struck ball, comparing its similarity in shape to that of the claw hammer.

FIG. 3 is an oblique view of a golf clubhead (consistent with a clubhead built using the principles of this invention) as if it is sitting on the ground (dotted line 1–2) and showing dotted lines (15–16) and (17–18) each of which respectively traverse the right and left inferior margin of the striking face of the club. The figure shows the heel and toe of the clubface elevated off the ground, forming the angles (13) and (14) at the intersection of the ground (dotted line 1–2) with dotted line (15–16) and at the intersection of the ground (dotted line 1–2) with dotted line (17–18). When the club is soled with either line (15–16) or line (17–18) against the ground, the shaft will form an angle with the ground equal to either angle (13) or angle (14), therefore angles (13) and (14) would each be a ground/shaft angle (or vertical shaft angle). the primary horizontal surfaces of the clubhead are labeled (20), (21), (22), & (23) and the primary vertical surfaces of the clubhead are labeled (24), (25), (26), & (27).

FIG. 4 is a hammer shaped cross section taken along the section lines A—A in FIG. 3.

DETAILED DESCRIPTION OF THE INVENTION

Figure 5:
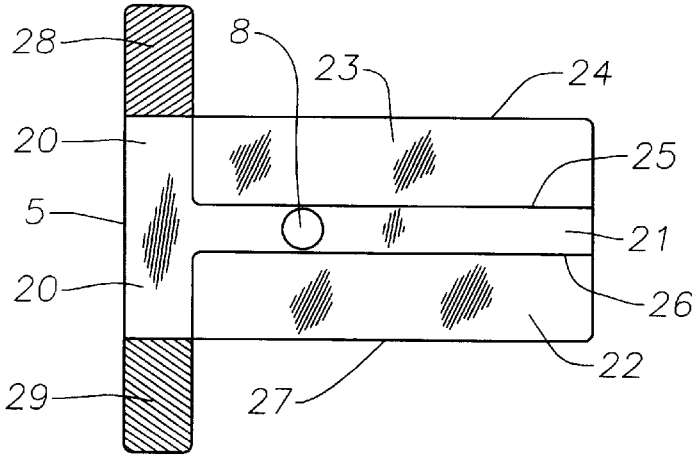
FIG. 5 is the golf clubhead of FIG. 3, in plan view showing the winglike areas (28) and (29) on top of the clubhead which can be camouflaged either with dull colors (crosshatched here as if painted black), altered reflective angle, or with a dull texture, to make the clubhead appear much longer and narrower than it actually is. This figure shows the clubhead like the golfer sees it if his eyes are directly over the clubhead. This is true if the vertical surfaces (24), (25), (26) & (27) are painted a contrasting color from the horizontal surfaces (20), (21), (22), and (23).

There are a number of physical principals related to putter/chipper design which can dramatically help limit the ill effects of the not-so-perfect stroke.

Club head design (shape) can assist in more easily maintaining clubhead alignment both before the stroke, and during the stroke, and clubhead design and weight can assist in creating more solid contact of club with the ball due both to a concentration of mass directly behind the impact area and because of the very low center of gravity.

Anyone who has ever attempted to drive a nail using the side of a hammer (rather than with the striking face) understands how much easier it is to alien the direction of the blow to and through the target by directing the long axis of the hammerhead along the direction of the blow. This principal also holds true for striking a golf ball. It is much easier to precisely direct a putting (or chipping) stroke along the long axis of an elongated clubhead, than by "slapping" the ball with a blade. He also understands that the force of the striking stroke is a much more solid blow, if that blow is concentrated directly behind the desired impact point rather than being broadly distributed about the wide striking surface of a blade.

Further, it should be noted that anytime an edge of the striking face of a golf clubhead "catches" on the grass prior to striking the golfball, it can and will alter the stroke. (this is particularly of concern on very soft strokes such as putting or short chip shots.) If that "catch" occurs on a line directly behind the ball, (i.e. hit it "fat"), it slows or stops the stroke. This problem can be remarkably improved by shaping the clubhead such that the angle of the sole of the club to its striking face is softened so as to remove any sharp edge, (or angle) and to then "ramp" or "round" the sole of the clubhead so it can very easily "bounce over the catch" with a minimum of resistance. This "bounce" (12) has been successfully used in clubs other than putters and chippers for many years (notably sand wedges and even fairway woods). See FIG. 1.

If the "catch" occurs at a place other than directly behind the ball, it is obvious that the further it occurs outside or inside the vertical axis of the stroke, the more likely it will be that the club face will turn or twist just before impact. Clearly then, a wide "blade" would be more likely to twist than would a much narrower striking face.

A pendulum's rhythmic swing is due to its mass being located close the outer most portion of its arc—generally the closer to that outer arc the mass occurs (relative to the overall mass of the pendulum arm), the more consistent the pendulum swings. In a golf club, the closer the weight of the club is to the sole of a club, the better the opportunity to effect the consistency of a pendulum swing. A clubhead designed to maximize its weight at the sole of the clubhead will markedly assist in this effort.

The energy of any striking blow is equal to the velocity of the blow squared times the mass of the striking objects and can be written as $E=MV^2$. Clearly, then, that energy can be increased by increasing either the velocity (speed of the clubhead) or the mass (weight of the clubhead). Because a change in clubhead speed affects the energy of the blow by the square of the velocity change, while a change in clubhead weight affects that energy only to the extent of the actual weight change, it becomes clear that for absolutely maximizing energy, one must concentrate on speed, while one can use mass to gain energy if a softer blow is desired.

In long (full swing) golf shots—which are largely controlled by the relatively unrestricted activity of larger muscles—it is important to maximize the energy of the blow as much as possible, so as to gain that ever important distance. It is therefore mandatory that one should do what he can to increase clubhead speed—the current trend being to use lighter materials and/or hollow clubheads to assist in this effort.

In very soft shots, however, like putts and chips, (which are controlled more by small muscles, and/or large muscles which are only partly activated), maximizing distance is simply not the objective, yielding instead to control of distance and control of direction, which can be easiest accomplished by the pendulum swing of a heavy clubhead. This heavy head is particularly important on very fast greens, (where one can determine the distance of the shot by essentially adjusting only the length of the pendulum backswing) and it is of magnified value to the "yippy" golfer!

Golfer's abilities wane with age and those who have reached a certain age frequently acquire a malady known to golfers as the "yips". The yips is an inability to execute a very soft shot as smoothly as in younger days, and is thought to be of neuromuscular origin, associated with a decreased ability to control small muscle activity. Although it is common among older golfers, the yips can occur at a surprisingly early age and in a variety of degrees of seriousness, ranging from fear, dread, and loss of confidence prior to the stroke; through jerky, off-line strokes; to a literal inability to start the club back on its backstroke. Ben Hogan, Sam Sneed, Bernard Langer, and B. J. Singe are only a few of the notable golfers who have struggled with the affliction in various ways, from using what turned out to be an illegal croquet style stroke to a grip whereby the right hand clamps the left forearm to the putter shaft. One of the most common and most effective efforts to date being the use of a club modified with an extended shaft.

It should be noted that there are at least three ways that a club can be hammer shaped—First, if the entire club is shaped like a hammer, (FIG. 2) that is, the striking face (5) of the club is equivalent to the striking face (5) of the hammer, and the shaft (or handle) (8) of the club is equivalent to the handle (or shaft) (8) of the hammer, (that is to say the club is hammer shaped in the vertical plane along which the ball is to travel); Second, if the cross section of the clubhead is hammer shaped such that most of the mass of the clubhead is contained in the sole portion of the clubhead, forming an inverted "T" shape, (See FIG. 4), and Third, if the clubhead is hammer shaped in the horizontal plane, so that looking at the clubhead from above, it appears hammer (or "T") shaped. (See FIG. 5).

Figure 7:
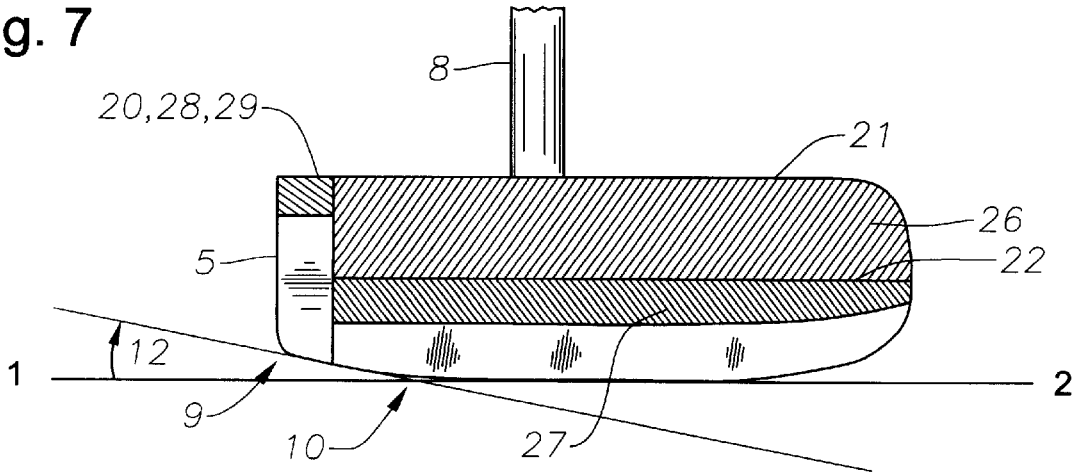
FIG. 7 is a side view of the golf clubhead shown in FIG. 3, with that clubhead sitting on the ground (dotted line 1–2), and showing the bounce angle (12) as the angle formed by the intersection of the line (9–10). Point (9) being the lowest point on the clubhead's striking face (5), and point (10) being the forwardmost point on the sole of the clubhead which touches the ground when the club is soled.

In theory then, for executing soft golf shots, the most effective club for solidly striking a putt or a chip on a desired line is a relatively heavy one with most of its weight at its sole, (such as one whose clubhead cross section is hammer shaped) and one which in general is more or less shaped like that of a hammer—that is, a relatively small striking face on one end of a relatively narrow and elongated clubhead, which is situated perpendicular to and directly behind its striking face, in line with the desired path of travel of the clubhead. The body of this "hammerhead" should have enough "bounce" (12) such that even the softened lower edge of the striking face can't "catch" in the grass. (refer to FIG. 7 and again to FIG. 1). Unfortunately, however, the U.S.G.A. Rules of Golf (Rule 4-1.d) restrict all golfclub design such that "the distance from the heel to the toe of the clubhead shall be greater than the distance from the face to the back", and the same rules (Rule-Appendix ii—4-1b) require that "except for putters, all of the heel portion of the club shall lie within 0.625 inches (16 mm) of the plane containing the axis of the shaft and the intended (horizontal) line of play". These rules, particularly in the case of chippers, eliminate a true hammerhead shape (particularly in the horizontal plane), and requires that, (in order to stay within the rules of golf), a highly modified hammerhead must therefore be used.

The illusion of a clubhead whose heel to toe distance is quite small compared to that of it's face to back demention can be accomplished by using color, reflective angle and/or texture of the finish to make the "wings" (28), & (29), of the wider striking blade seem to "disappear" to the user. (See FIG. 5)

Figure 6:
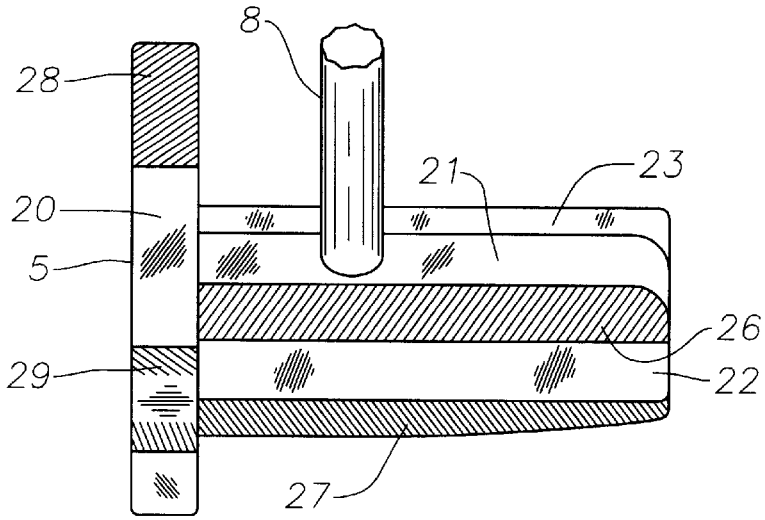
FIG. 6 is the golf clubhead of FIG. 3 showing what the golfer sees if his eyes are not directly over the clubhead, and the vertical surfaces (24), (25), (26), & (27) are painted a contrasting color from that of the horizontal surfaces (20), (21), (22), and (23). In this case the vertical surfaces are crosshatched as if they are orange, and the horizontal surfaces are left uncolored, but any appropriate color difference would work.

If used properly, colors, and/or reflective angle, and/or texture differences can also be used as invaluable tools in aligning the clubhead for the stroke. For example, it is very important for most golfers, that their eyes be located directly over the clubhead before and during the putting or chipping stroke. If then, the clubhead is designed with distinctly vertical surfaces (24), (25), (26) & (27), that can be a different color or texture from the rest of the clubhead, then the golfer, at address, would not see the contrasting colors of the vertical surfaces when his eyes are directly over the clubhead. This phenomenon works equally well if other patterns, (ie. combinations of color and texture) can be used to verify that the golfers eyes are properly aligned to make the stroke. (See FIGS. 5 and 6).

The "no catch" effect of a very narrow striking face (i.e. like that of a hammer) can then be achieved by elevating the lower edge of the striking face, (where the face meets the sole), at the toe and/or at the heel of the striking face, (See FIG. 3, Angles 13 and 14). In this figure, effectively leaving only the central portion of the clubface with which to strike the ball.

It is interesting to note that although Hattoti in his U.S. Pat. No. 5,458,335 (copy of which is included herewith) appears to elevate the toe and heel of the face of his club, obviously it is not to avoid the torque producing "catches" but rather so that the club can be swung conventionally in a right-handed fashion from one side such that, for example, the putter face strikes the ball, or the club can be turned around and swung, still in a right-handed fashion, so that the wedge face strikes the ball. Hattoti's double-sided wedge/putter can not be legally used in a U.S.G.A. sanctioned match.

What is claimed is:

1. A golf clubhead comprising:

a clubhead body;

said clubhead body being elongated from forward to back, with said elongated body having, a forward striking face and a tail end, an upper top surface and an opposing lower sole surface; a heel side and an opposing toe side; and wherein said forward striking face is shaped into a ball striking blade that is perpendicular to said elongated body and is slightly longer from heel to toe than is said clubhead body from its forward end to its tail end, substantially creating a configuration that is generally "T" shaped when the clubhead is viewed from above in its plan view; and wherein said upper top surface of said body extends perpendicularly in a rearward direction from a rear of said ball striking blade to form a relatively flat elongated platform, said platform extending longitudinally from the forward striking face to the tail of said clubhead body, and having heel and opposite toe sides that are substantially parallel both one to another and to a vertical plane which runs longitudinally from said forward striking face to said tail end of said clubhead body, along its centerline, while being perpendicular to said elongated platform; and wherein said lower sole surface of said body is wider than said platform thereby creating a shelf on both the heel side and the toe side of said clubhead body, extending in a heelward direction from the heel side, and in a toeward direction from the toe side, generally in a direction that is perpendicular to said parallel platform sides, such configuration of both platform and shelves creating substantially the shape of an inverted "T" when the body is viewed in a cross section along said body, such that more of the clubhead mass is located closer to the sole of the clubhead than to the upper top surface of said clubhead; and means for attaching a shaft to the body of the clubhead.

2. The golf clubhead of claim 1, wherein said striking blade, clubhead body, platform, and sole shelves are one integral part.

3. The golf clubhead of claim 1, wherein said elongated platform top is parallel to the ground, and said elongated platform sides are perpendicular to the ground, when said clubhead is placed on the ground in the ball striking position.

4. The golf clubhead of claim 1, wherein said shaft is attached to the clubhead body at an angle of 10 or more degrees from vertical in a plane which is both perpendicular to the ground and perpendicular to the long axis of said clubhead when said clubhead is placed on the ground in the ball striking position.

5. The golf clubhead of claim 1, wherein said shaft attachment is located on said elongated platform.

6. The golf clubhead of claim 1, wherein said shaft is attached vertically to said clubhead when said clubhead is placed on the ground in the ball striking position.

7. The golf clubhead of claim 6, wherein when said clubhead is placed on the ground in the ball striking position, the lower surface of said striking blade and the sole of said clubhead body are tapered at least 10 degrees upward from the longitudinal centerline of said clubhead body, as one moves both outward toward said toe and inward toward said heel of said striking blade and of said clubhead body.

8. The golf clubhead of claim 7, wherein the shaft makes at least a 10 degree angle with the ground in that plane which is perpendicular both to the long axis of said clubhead body and to the ground when said clubhead is placed on the ground such that both the centerline of the sole of said clubhead body and the heel of said striking blade are simultaneously laid against the ground.

9. The golf clubhead of claim 7, wherein the shaft makes at least a 10 degree angle with the ground in that plane which is perpendicular both to the long axis of said clubhead body and to the ground when said clubhead is placed on the ground such that both the centerline of the sole of said clubhead body and the toe of said striking blade are simultaneously laid against the ground.

10. The golf clubhead of claim 3, wherein the horizontal top surface of said elongated platform and the top surface of said shelves are of different color or texture from that of said vertical sides of said platform or of the vertical heel and toe sides of said shelves, such that there is a definite visual contrast between the vertical surfaces and the horizontal surfaces.

* * * * *